US009464512B2

(12) United States Patent
Kalia et al.

(10) Patent No.: US 9,464,512 B2
(45) **Date of Patent: *Oct. 11, 2016**

(54) METHODS FOR FLUID MONITORING IN A SUBTERRANEAN FORMATION USING ONE OR MORE INTEGRATED COMPUTATIONAL ELEMENTS

(75) Inventors: Nitika Kalia, Cypress, TX (US); Robert Freese, Pittsboro, NC (US)

(73) Assignee: Halliburton Energy Services, Inc., Houston, TX (US)

( * ) Notice: Subject to any disclaimer, the term of this patent is extended or adjusted under 35 U.S.C. 154(b) by 305 days.

This patent is subject to a terminal disclaimer.

(21) Appl. No.: 13/566,583

(22) Filed: Aug. 3, 2012

(65) Prior Publication Data

US 2013/0032339 A1 Feb. 7, 2013

Related U.S. Application Data

(63) Continuation-in-part of application No. 13/198,915, filed on Aug. 5, 2011.

(51) Int. Cl.

| | |
|---|---|
| ***E21B 43/25*** | (2006.01) |
| ***E21B 43/16*** | (2006.01) |
| ***E21B 47/00*** | (2012.01) |
| ***E21B 47/10*** | (2012.01) |

(52) U.S. Cl.

CPC ..... *E21B 43/16* (2013.01); *E21B 43/25* (2013.01); *E21B 47/0002* (2013.01); *E21B 47/10* (2013.01)

(58) Field of Classification Search

CPC ..... G01N 21/636; G01N 21/8507
USPC ..... 166/250.01
See application file for complete search history.

(56) References Cited

U.S. PATENT DOCUMENTS

| | | | |
|---|---|---|---|
| 5,110,744 | A | 5/1992 | Baughman et al. |
| 5,186,255 | A | 2/1993 | Corey |
| 5,431,227 | A | 7/1995 | Montgomery et al. |
| 5,540,825 | A | 7/1996 | Yeung et al. |
| 5,680,900 | A | 10/1997 | Nguyen et al. |
| 5,737,076 | A | 4/1998 | Glaus et al. |
| 5,996,690 | A | 12/1999 | Shaw et al. |

(Continued)

FOREIGN PATENT DOCUMENTS

| | | |
|---|---|---|
| EP | 0859236 A1 | 8/1998 |
| EP | 2320027 A1 | 5/2011 |

(Continued)

OTHER PUBLICATIONS

International Search Report and Written Opinion for PCT/US2012/047065 dated Jul. 16, 2013.

(Continued)

*Primary Examiner* — Angela M DiTrani
*Assistant Examiner* — Ashish Varma
(74) *Attorney, Agent, or Firm* — McDermott Will & Emery LLP; Craig Roddy

(57) ABSTRACT

Methods for fluid monitoring in a subterranean formation can comprise: providing a diverting fluid comprising a diverting agent; introducing the diverting fluid into a subterranean formation comprising one or more subterranean zones; and monitoring a disposition of the diverting fluid within the subterranean formation using one or more integrated computational elements in optical communication with the subterranean formation.

22 Claims, 2 Drawing Sheets

(56) References Cited

U.S. PATENT DOCUMENTS 6,016,191 A 1/2000 Ramos et al.
6,198,531 B1 3/2001 Myrick et al.
6,268,911 B1 7/2001 Tubel et al.
6,529,276 B1 3/2003 Myrick
6,729,400 B2 5/2004 Mullins et al.
6,755,978 B2 6/2004 Oddie
6,880,566 B2 4/2005 Newman
7,123,844 B2 10/2006 Myrick
7,236,237 B2 6/2007 Schmilovitch et al.
7,623,233 B2 11/2009 Freese et al.
7,671,973 B2 3/2010 Van Beek et al.
7,697,141 B2 4/2010 Jones et al.
7,789,171 B2 9/2010 Grayson et al.
7,834,312 B2 11/2010 Lievois et al.
7,834,999 B2 11/2010 Myrick et al.
7,875,455 B1 1/2011 Li et al.
7,911,605 B2 3/2011 Myrick et al.
7,920,258 B2 4/2011 Myrick et al.
8,253,619 B2 8/2012 Holbrook et al.
8,345,234 B2 1/2013 Myrick et al.
8,547,556 B2 10/2013 Irani
8,619,256 B1 12/2013 Pelletier et al.
8,780,352 B2 7/2014 Freese et al.
8,823,939 B2 9/2014 Freese et al.
8,879,053 B2 11/2014 Freese et al.
8,908,165 B2 12/2014 Tunheim et al.
8,912,477 B2 12/2014 Freese et al.
8,941,046 B2 1/2015 Freese et al.
8,960,294 B2 2/2015 Freese et al.
8,997,860 B2 4/2015 Freese et al.
9,013,698 B2 4/2015 Freese et al.
9,013,702 B2 4/2015 Freese et al.
9,019,501 B2 4/2015 Freese et al.
9,074,990 B2 7/2015 Freese et al.
9,080,943 B2 7/2015 Freese et al.
9,103,716 B2 8/2015 Tunheim et al.
9,103,720 B2 8/2015 Russell et al.
9,103,767 B2 8/2015 Freese et al.
9,142,002 B2 9/2015 Dutton
9,170,154 B2 10/2015 Myrick et al.
9,170,208 B2 10/2015 Tunheim et al.
9,176,052 B2 11/2015 Tunheim et al.
9,182,282 B2 11/2015 Myrick et al.
9,182,355 B2 11/2015 Tunheim et al.
9,206,386 B2 12/2015 Tunheim et al.
9,222,348 B2 12/2015 Freese et al.
9,222,892 B2 12/2015 Tunheim et al.
9,261,461 B2 2/2016 Tunheim et al.
2001/0020675 A1 9/2001 Tubel et al.
2001/0023614 A1 9/2001 Tubel et al.
2002/0023752 A1 2/2002 Qu et al.
2002/0109080 A1 8/2002 Tubel et al.
2002/0154315 A1 10/2002 Myrick
2003/0056581 A1 3/2003 Turner et al.
2003/0143580 A1 7/2003 Straus
2003/0145988 A1 8/2003 Mullins et al.
2004/0045705 A1 3/2004 Gardner et al.
2004/0129884 A1 7/2004 Boyle et al.
2004/0179194 A1 9/2004 Schmilovitch et al.
2005/0088653 A1 4/2005 Coates et al.
2005/0151968 A1 7/2005 Drake et al.
2006/0102343 A1 5/2006 Skinner et al.
2006/0142955 A1 6/2006 Jones et al.
2006/0158734 A1 7/2006 Schuurmans et al.
2007/0095528 A1* 5/2007 Ziauddin ..... E21B 43/25 166/252.3
2007/0114372 A1 5/2007 Lievois et al.
2007/0177240 A1 8/2007 Van Beek et al.
2007/0215385 A1 9/2007 Anderson
2007/0281870 A1 12/2007 Robb et al.
2007/0282647 A1 12/2007 Freese et al.
2007/0291251 A1 12/2007 Rensen et al.
2008/0000635 A1 1/2008 Rioufol et al.
2008/0041594 A1 2/2008 Boles et al.
2008/0094623 A1 4/2008 Schuurmans et al.
2008/0133193 A1 6/2008 Gdanski et al.
2008/0166720 A1 7/2008 Hsieh et al.
2008/0217011 A1 9/2008 Pauls et al.
2008/0262737 A1 10/2008 Thigpen et al.
2008/0309930 A1 12/2008 Rensen
2009/0002697 A1 1/2009 Freese et al.
2009/0015819 A1 1/2009 Van Beek et al.
2009/0033933 A1 2/2009 Myrick et al.
2009/0073433 A1 3/2009 Myrick et al.
2009/0087912 A1 4/2009 Ramos et al.
2009/0097024 A1 4/2009 Blackburn et al.
2009/0154288 A1 6/2009 Heathman
2009/0205821 A1 8/2009 Smith
2009/0216504 A1 8/2009 Priore et al.
2009/0219512 A1 9/2009 Myrick et al.
2009/0219538 A1 9/2009 Myrick et al.
2009/0219539 A1 9/2009 Myrick et al.
2009/0219597 A1 9/2009 Myrick et al.
2009/0245718 A1* 10/2009 Li ..... B82Y 20/00 385/12
2009/0299946 A1 12/2009 Myrick et al.
2009/0305330 A1 12/2009 Kroon et al.
2009/0316150 A1 12/2009 Myrick et al.
2010/0006292 A1 1/2010 Boles et al.
2010/0042348 A1 2/2010 Bakker
2010/0051266 A1 3/2010 Roddy et al.
2010/0073666 A1 3/2010 Perkins et al.
2010/0084132 A1 4/2010 Noya et al.
2010/0102986 A1 4/2010 Benischek et al.
2010/0148785 A1 6/2010 Schaefer et al.
2010/0149523 A1 6/2010 Heideman et al.
2010/0149537 A1 6/2010 Myrick et al.
2010/0182600 A1 7/2010 Freese et al.
2010/0195105 A1 8/2010 Myrick et al.
2010/0245096 A1 9/2010 Jones et al.
2010/0265509 A1 10/2010 Jones et al.
2010/0268470 A1 10/2010 Kamal et al.
2010/0269579 A1 10/2010 Lawrence et al.
2010/0273208 A1 10/2010 Takenaka
2010/0285105 A1 11/2010 Radianingtyas
2010/0302539 A1 12/2010 Myrick et al.
2010/0326659 A1 12/2010 Schultz et al.
2010/0328669 A1 12/2010 Myrick et al.
2011/0023588 A1 2/2011 Westner et al.
2011/0042320 A1 2/2011 Allen
2011/0166046 A1 7/2011 Weaver et al.
2011/0186290 A1 8/2011 Roddy et al.
2011/0197662 A1* 8/2011 McAlister ..... G01N 1/405 73/61.59
2011/0212512 A1 9/2011 Wang et al.
2011/0312012 A1 12/2011 Skinderso et al.
2012/0000643 A1 1/2012 Bruun et al.
2012/0135396 A1 5/2012 McDevitt et al.
2012/0150451 A1 6/2012 Skinner et al.
2012/0160329 A1 6/2012 MacKenzie et al.
2012/0208264 A1 8/2012 Bernd
2012/0250017 A1 10/2012 Morys et al.
2013/0031964 A1 2/2013 Tunheim et al.
2013/0031970 A1 2/2013 Freese et al.
2013/0031971 A1 2/2013 Freese et al.
2013/0031972 A1 2/2013 Freese et al.
2013/0032333 A1 2/2013 Freese et al.
2013/0032340 A1 2/2013 Freese et al.
2013/0032344 A1 2/2013 Freese et al.
2013/0032345 A1 2/2013 Freese et al.
2013/0033701 A1 2/2013 Tunheim et al.
2013/0033702 A1 2/2013 Tunheim et al.
2013/0034842 A1 2/2013 Tunheim et al.
2013/0284895 A1 10/2013 Freese et al.
2014/0263974 A1 9/2014 Freese et al.
2015/0015884 A1 1/2015 Russell et al.
2015/0167456 A1 6/2015 Irani
2015/0212232 A1 7/2015 Perkins et al.
2015/0241337 A1 8/2015 Talabi et al.
2015/0260703 A1 9/2015 Mitchell
2015/0293013 A1 10/2015 Tunheim et al.
2015/0300945 A1 10/2015 Gao et al.

(56) References Cited

U.S. PATENT DOCUMENTS

| | | | |
|---|---|---|---|
| 2015/0330215 | A1 | 11/2015 | Jamison et al. |
| 2015/0346084 | A1 | 12/2015 | Russell et al. |

FOREIGN PATENT DOCUMENTS

| | | | |
|---|---|---|---|
| FR | 2954563 | A1 | 6/2011 |
| GB | 2353310 | A | 2/2001 |
| JP | 2002112761 | A1 | 4/2002 |
| JP | 2009284813 | A | 12/2009 |
| WO | 9409266 | A1 | 4/1994 |
| WO | 9850680 | A2 | 11/1998 |
| WO | 2004018840 | A1 | 3/2004 |
| WO | 2006063094 | A1 | 6/2006 |
| WO | 2007062001 | A2 | 5/2007 |
| WO | 2008121692 | A1 | 10/2008 |
| WO | 2009055200 | A2 | 4/2009 |
| WO | 2009055220 | A2 | 4/2009 |
| WO | 2009077758 | A1 | 6/2009 |
| WO | 20100068870 | A2 | 6/2010 |
| WO | 2011022158 | A1 | 2/2011 |
| WO | 2011063086 | A1 | 5/2011 |
| WO | 2013022558 | A2 | 2/2013 |
| WO | 2013022570 | A2 | 2/2013 |
| WO | 2013162860 | A1 | 10/2013 |
| WO | 2014042909 | A1 | 3/2014 |
| WO | 2014042933 | A1 | 3/2014 |
| WO | 2014043010 | A1 | 3/2014 |
| WO | 2014043050 | A1 | 3/2014 |
| WO | 2014043057 | A1 | 3/2014 |

OTHER PUBLICATIONS

International Search Report and Written Opinion for PCT/US2012/045677 dated Jul. 16, 2013.
Official Action for Australian Patent Application No. 2013 252841 dated Nov. 10, 2014.
Official Action for Australian Patent Application No. 2013 252881 dated Nov. 12, 2014.
International Search Report and Written Opinion for PCT/US2013/058864 dated Dec. 16, 2013.
International Preliminary Report on Patentability for PCT/US2012/046892 dated Feb. 20, 2014.
International Search Report and Written Opinion for PCT/US2012/044148 dated Oct. 4, 2012.
International Search Report and Written Opinion for PCT/US2012/046898 dated Apr. 5, 2013.
Official Action for Australian Patent Application 2012294881 dated May 22, 2014.
International Search Report and Written Opinion for PCT/US2013/057832 dated Nov. 22, 2013.
International Search Report and Written Opinion for PCT/US2013/058041 dated Dec. 2, 2013.
International Search Report and Written Opinion for PCT/US2013/058700 dated Dec. 6, 2013.
International Search Report and Written Opinion for PCT/US2012/047058 dated Oct. 29, 2012.
Official Action for Singapore Patent Application No. 11201500780V dated Jun. 16, 2015.
Official Action for Australian Patent Application No. 2013252855 dated Apr. 15, 2015.
Dai et al., Molecular Factor Computing for Predictive Spectroscopy, Pharmaceutical Research, vol. 24, No. 8, 2007, pp. 1441-1449.
Mendendorp J., et al., Application of Integrated Sensing and Processing in Spectroscopic Imaging and Sensing, Journal of Chemometrics, vol. 19, 2005, pp. 533-542.
Official Action for New Zealand Patent Application No. NZ 704529 dated Jun. 9, 2015.
Official Action for Canadian Patent Application No. CA 2,842,191 dated May 6, 2015.
Halliburton Brochure for "Acid-on-the-Fly (AOF) Blending System," published 2009.
Official Action for Canadian Patent Application No. 2,843,518 dated Nov. 6, 2015.
Supplementary European Search Report received in corresponding EP Application No. 13836274, dated Apr. 25, 2016.
Sullivan et al., "Implementation of a Numerical Needle Method for Thin-Film Design," Applied Optics, Optical Society of America, Washington, DC; US, vol. 35, No. 28, Oct. 1, 1996, pp. 5484-5492, XP000885005, ISSN: 0003-6935, DOI: 10.1364/AO.35.005484.
Priore, R.J. et al, "Minature Stereo Spectral Imaging System for Multivariate Optical Computing," Society for Applied Spectroscopy, 2004, vol. 58, No. 7, pp. 870-873.
Patent Examination Report No. 1 received in corresponding Australian Application No. 2013315903, dated Aug. 8, 2016.
Supplementary European Search Report received in EP Application No. 13837009, dated Mar. 3, 2016.
Written Opinion received in corresponding Singapore Application 11201500600V, dated Mar. 29, 2016.
Examination Report received in corresponding Canadian Application No. 2,882,203, dated Jun. 21, 2016.
Supplementary European Search Report received in EP Application No. 13837413, dated Jun. 16, 2016.
Miller, M.J. et al., Evaluation of the BioVigilant(R) IMD-A (TM), a novel optical spectroscopy technology for the continuous and real-time environmental monitoring of viable and nonviable particles. Part I. Review of the technology and comparative studies with conventional methods. PDA J. Pharm Sci Technol., May-Jun. 2009, vol. 63, No. 3, pp. 245-258.
Official Action for Canadian Patent Application 2,842,191 dated Dec. 17, 2015.
Official Action for Canadian Patent Application 2,879,750 dated Dec. 4, 2015.
Official Action for Canadian Patent Application 2,842,944 dated Dec. 23, 2015.

* cited by examiner

METHODS FOR FLUID MONITORING IN A SUBTERRANEAN FORMATION USING ONE OR MORE INTEGRATED COMPUTATIONAL ELEMENTS

CROSS-REFERENCE TO RELATED APPLICATIONS

This application is a continuation-in-part of U.S. patent application Ser. No. 13/198,915, filed Aug. 5, 2011, which is incorporated herein by reference in its entirety.

BACKGROUND

The present invention generally relates to methods for fluid monitoring, and, more specifically, to methods for monitoring the disposition of a fluid in a subterranean formation.

When conducting operations within a subterranean formation, it can oftentimes be desirable to know with some precision the constituent concentrations and/or characteristics of a fluid present in, being introduced to, or being produced from the formation. As used herein, the term "constituent" will be used to refer to a substance present within a fluid. As used herein, the term "characteristic" will be used to refer to the value of a chemical property or a physical property, which also may include an optical property or a mechanical property. Classically, it has been conventional to sample fluids encountered in the course of conducting subterranean operations and analyze them using off-line laboratory analyses, including spectroscopic and/or wet chemical methods. Although such retrospective analyses can be satisfactory in many instances, they are usually not sufficiently rapid to allow real-time or near real-time process control to take place.

Once removed from a subterranean environment, many fluids may exhibit different properties than they do downhole. Although fluids can be sampled from a subterranean environment and brought to the surface for analysis, there is generally no way to conclusively determine if the fluid has been changed in some manner during transit. In addition, highly specialized sampling techniques can often be needed, potentially adding to process complexity and costs. As an added difficulty, downhole fluid analysis techniques can oftentimes be difficult to perform and interpret. Many conventional spectroscopic instruments lack the ruggedness needed for deployment in the harsh conditions of a subterranean environment. More rugged techniques suitable for being carried out downhole may not be sufficiently rapid to allow real-time or near real-time process control to take place.

In addition to analyzing a fluid while it is downhole, it can oftentimes be desirable to know the downhole disposition of a fluid following its introduction to a subterranean formation. For example, it can be desirable to understand the zonal placement of a fluid in the subterranean formation, but many methods for determining downhole fluid disposition can be difficult to carry out and interpret. One technique that has been commonly used to determine fluid disposition within subterranean formations is distributed temperature sensing (DTS), which monitors the thermal front of an injected fluid in comparison to the formation temperature. Thief zones, cross-flow across producing zones, geothermal gradients, formation water, and other factors can complicate a DTS fluid disposition analysis. In addition, DTS analyses can take several hours to acquire and interpret, again precluding real-time or near real-time process control.

Placement of a fluid in an intended region of a subterranean formation can be particularly problematic when there are multiple subterranean zones within the formation, each zone likely having a different effective fluid permeability. One way in which the problem of differential permeability can be addressed is though fluid diversion operations, which may involve physical diversion (e.g., packers) or chemical diversion. Chemical diverting agents (e.g., relative permeability modifiers, sealant compositions, and the like) may form a fluid barrier within the subterranean formation that at least partially redirects the fluid flow to a different subterranean zone, often a zone with a lower effective fluid permeability. Without employing fluid diversion techniques, a fluid may naturally flow to the subterranean zone having the highest effective fluid permeability. This can lead to over-stimulation of some subterranean zones while leaving other subterranean zones under-stimulated. For example, in a wellbore having a substantially horizontal section, the heel of the wellbore may be over-stimulated by a fluid being introduced thereto, while the toe of the wellbore receives insufficient fluid and is under-stimulated. In even more extreme cases, a fluid may enter a subterranean zone where its presence can be unwanted and detrimental, resulting in reduced production and/or formation damage. Thus, improper fluid placement in a subterranean formation can have significant economic ramifications due to waste of material goods, loss of production time, and time and expense of potential remediation operations.

Although fluid diversion techniques can oftentimes be used successfully in subterranean operations to direct a fluid to a desired subterranean zone, the previously mentioned issues regarding determination of the ultimate fluid disposition in the subterranean formation may still remain. Namely, it may still be difficult to rapidly determine if a fluid diversion operation has resulted in the intended redirection of another fluid. Likewise, there is no way to rapidly determine if a diverting fluid itself has been placed in the correct location within a subterranean formation to properly redirect another fluid to a different location. In addition to proper placement of a diverting fluid, chemical compatibility of the diverting fluid with the subterranean formation or a fluid therein can impact the ultimate success of a fluid diversion operation.

Injection operations are another subterranean operation in which it can be highly desirable to know the subterranean disposition of a fluid. In injection operations, an injection fluid, often containing a dye or like tracer, is introduced into a wellbore that is fluidly connected to one or more neighboring wellbores. The fluid pressure in the injection wellbore may be used to drive the production of another fluid from the neighboring wellbore(s). Besides merely observing increased production from the neighboring wellbore(s), the success of an injection operation can also be evaluated by analyzing the neighboring wellbore(s) for the injection fluid (e.g., by analyzing for migration of the tracer from the injection wellbore to the neighboring wellbore(s)).

In addition to evaluating the disposition of a fluid within a subterranean formation, it can also be desirable to know if the fluid is producing a desired effect therein. Evidence of a fluid producing a desired effect may include, for example, the creation or lack of creation of a substance in the presence or absence of the fluid. By way of non-limiting example, in an acidizing operation, the formation matrix may react with an acid to produce soluble species that may not otherwise be present in abundance. It should be noted that even if a fluid is disposed as intended in a subterranean formation, the intended effect of introducing the fluid is not necessarily guaranteed to be achieved. For example, the flow rate of the fluid past the formation matrix may be too fast or too slow for the fluid to have its intended effect, or the fluid itself may sometimes be insufficient in some manner. In even more extreme instances, a fluid may interact with a component of the formation matrix in an unwanted manner to produce damage in the subterranean formation.

Carbonate formations are one type of subterranean formation in which it can be highly desirable to know the disposition and effect of a fluid present therein, particularly an acidizing fluid. When acidizing a carbonate formation, it may be desirable to create wormholes in a treated subterranean zone in order to increase the formation's permeability. In some instances, even if an acidizing fluid is directed to an intended zone of a carbonate formation, wormhole creation may not occur. For example, if the acidizing fluid is not introduced to the formation at the proper rate, simple erosion of the surface of the subterranean formation may occur, rather than the desired wormhole creation needed for effective stimulation to take place. Monitoring only the fluid disposition in this case may be insufficient to determine the success or failure of the acidizing operation.

SUMMARY

The present invention generally relates to methods for fluid monitoring, and, more specifically, to methods for monitoring the disposition of a fluid in a subterranean formation.

In some embodiments, the present disclosure provides methods comprising: providing a diverting fluid comprising a diverting agent; introducing the diverting fluid into a subterranean formation comprising one or more subterranean zones; and monitoring a disposition of the diverting fluid within the subterranean formation using one or more integrated computational elements in optical communication with the subterranean formation.

In some embodiments, the present disclosure provides methods comprising: providing an acidizing fluid comprising at least one acid or acid-generating compound; introducing the acidizing fluid into a subterranean formation comprising one or more subterranean zones; and monitoring a disposition of the acidizing fluid within the subterranean formation using one or more integrated computational elements in optical communication with the subterranean formation.

The features and advantages of the present invention will be readily apparent to one having ordinary skill in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to one having ordinary skill in the art and the benefit of this disclosure.

DETAILED DESCRIPTION

Figure 1:
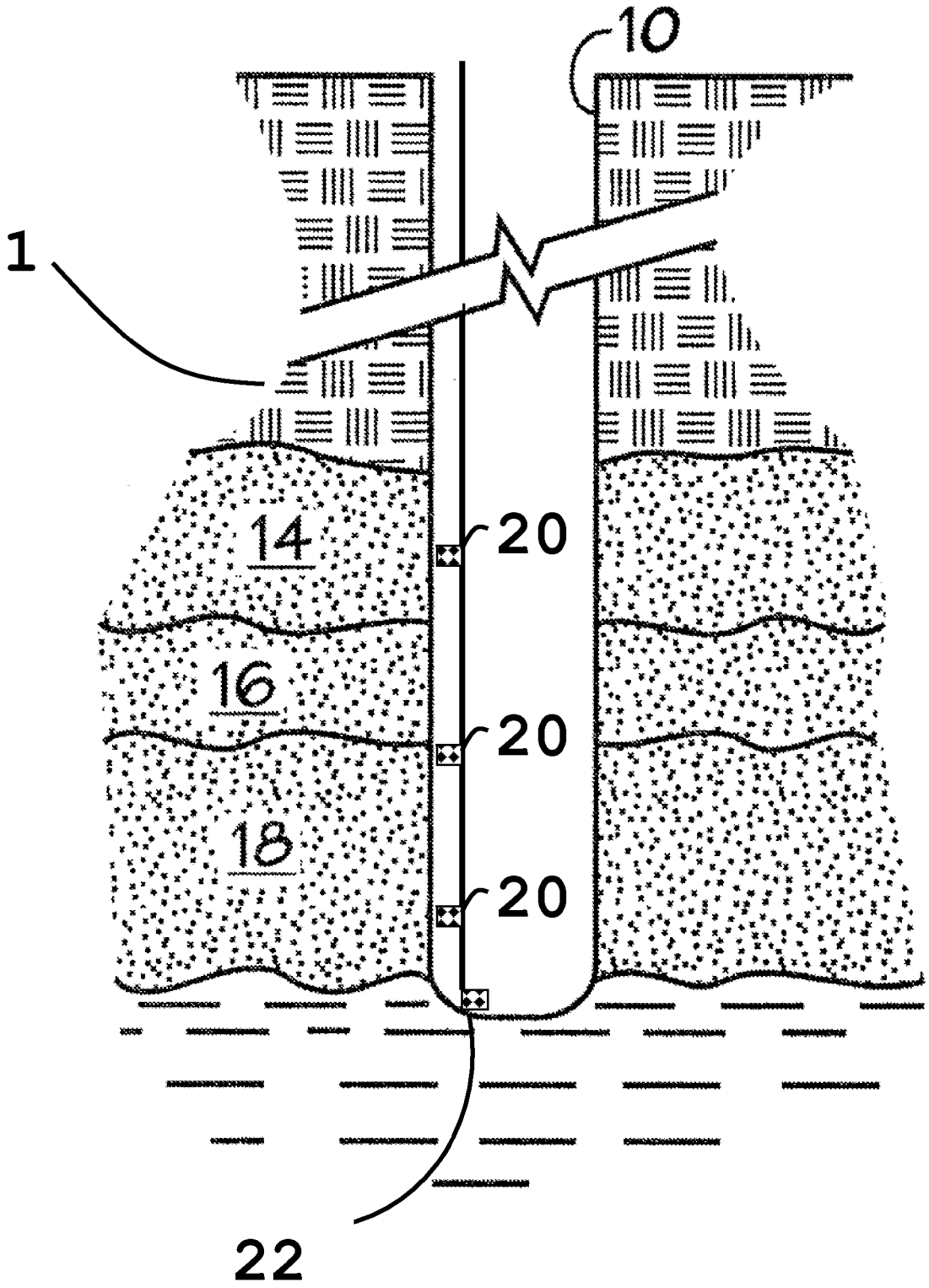
FIG. 1 shows a schematic of a subterranean formation presenting an illustrative placement of integrated computational elements therein.

The present invention generally relates to methods for fluid monitoring, and, more specifically, to methods for monitoring the disposition of a fluid in a subterranean formation.

Despite the difficulties that can be encountered in monitoring one or more fluids within a subterranean formation, significant benefits can be realized in doing so, particularly according to the methods described herein. In contrast to conventional spectroscopic instruments and techniques, the methods described herein utilize optical computing devices containing an integrated computational element (ICE), which can be well suited for deployment in a subterranean formation and analysis of a fluid's disposition therein. Each integrated computational element within an optical computing device can be specifically configured to detect a constituent or characteristic of interest in a sample, even when complex mixtures of constituents are present. The theory behind optical computing and a description of some conventional optical computing devices are provided in more detail in the following commonly owned United States Patents and United States Patent Application Publications, each of which is incorporated herein by reference in its entirety: U.S. Pat. Nos. 6,198,531, 6,529,276, 7,123,844, 7,834,999, 7,911,605, 7,920,258, 20090219538, 20090219539, and 20090073433. Accordingly, the theory behind optical computing will not be discussed in any extensive detail herein unless needed to better describe one or more embodiments of the present disclosure. Unlike conventional spectroscopic instruments, which produce a spectrum needing further interpretation to obtain a result, the ultimate output of optical computing devices is a real number that can be correlated in some manner with a constituent concentration or characteristic of a sample. The operational simplicity of optical computing devices allows them to rapidly output a result, in real-time or near real-time, in some embodiments.

When monitoring more than one analyte at a time, various configurations for multiple ICEs can be used, where each ICE has been configured to detect a particular characteristic or analyte of interest. In some embodiments, the characteristic or analyte can be analyzed sequentially using multiple ICEs that are presented to a single beam of electromagnetic radiation being reflected from or transmitted through a sample. In some embodiments, multiple ICEs can be located on a rotating disc, where the individual ICEs are only exposed to the beam of electromagnetic radiation for a short time. Advantages of this approach can include the ability to analyze multiple analytes using a single optical computing device and the opportunity to assay additional analytes simply by adding additional ICEs to the rotating disc. In various embodiments, the rotating disc can be turned at a frequency of about 10 RPM to about 30,000 RPM such that each analyte in a sample is measured rapidly. In some embodiments, these values can be averaged over an appropriate time domain (e.g., about 1 millisecond to about 1 hour) to more accurately determine the sample characteristics.

In addition, significant benefits can be realized by combining the outputs of two or more integrated computational elements with one another when analyzing a single constituent or characteristic of interest. Specifically, in some instances, significantly increased detection accuracy may be realized. Detection techniques for constituents and characteristics using combinations of two or more integrated computational elements are described in commonly owned U.S. patent application Ser. Nos. 13/456,255, 13/456,264, 13/456,283, 13/456,302, 13/456,327, 13/456,350, 13/456,379, 13/456,405, and 13/456,443, each filed on Apr. 26, 2012 and incorporated herein by reference in its entirety. It is to be recognized that any of the embodiments described herein may be carried out through combining the outputs of two or more integrated computational elements with one another.

As alluded to above, the operational simplicity of optical computing devices makes them rugged and well suited for field or process environments, including deployment within a subterranean formation. Uses of conventional optical computing devices for the analysis of fluids and other substances commonly encountered in the oil and gas industry, including while deployed within a subterranean formation, are described in commonly owned U.S. patent application Ser. Nos. 13/198,915, 13/198,950, 13/198,972, 13/204,005, 13/204,046, 13/204,123, 13/204,165, 13/204,213, and 13/204,294, each filed on Aug. 5, 2011 and incorporated herein by reference in its entirety. Illustrative materials that may be analyzed by such techniques include, for example, treatment fluids (e.g., drilling fluids, acidizing fluids, fracturing fluids, and the like), pipeline fluids, bacteria, carrier fluids, source materials, produced water, produced hydrocarbon fluids, subterranean surfaces, and the like.

The present inventors recognized that the subsurface utility of optical computing devices may be extended through using them to monitor fluid disposition within a subterranean formation. The present inventors do not currently believe that there has been any contemplation in the art to use optical computing devices in this fashion. Use of optical computing devices for monitoring fluid disposition within a subterranean formation may present a number of advantages, as discussed hereinafter.

The present inventors contemplate deploying one or more integrated computational elements in optical communication with a subterranean formation to monitor the location and movement of a fluid therein. As used herein, the term "optical communication" refers to the receipt of electromagnetic radiation from within a subterranean formation. In some embodiments, the integrated computational element(s) may be located within the subterranean formation so as to receive electromagnetic radiation therefrom. In other embodiments, the integrated computational element(s) may be located external to the subterranean formation but in optical communication therewith by way of an optical fiber or like electromagnetic radiation conduit extending into the subterranean formation. In either case, the integrated computational element(s) may receive electromagnetic radiation from one or more points of interest within the subterranean formation in order to evaluate the fluid disposition therein.

Depending on the location(s) of the integrated computational element(s) in the subterranean formation, various types of information can be determined in real-time or near real-time based upon fluid flow into or out of the subterranean formation. For example, in some embodiments, the consumption of a substance in a treatment fluid can be monitored as the treatment fluid passes through various subterranean zones. In other embodiments, the flow pathway(s) of the treatment fluid in the subterranean formation can be monitored as the treatment fluid passes the various integrated computational element(s). Information obtained from the integrated computational element(s) can not only be used to map the morphology of the subterranean formation, but it can also indicate whether a parameter of the treatment fluid needs to be changed in order to perform a more effective treatment. For example, in some embodiments, the treatment fluid may be altered in order to address specific conditions that are being encountered downhole. In addition, in some embodiments, a treatment fluid can be monitored to ensure that it does not change in an undesirable way when introduced into the downhole environment. In the event that the treatment fluid undesirably changes upon being introduced downhole, the treatment fluid being introduced into the subterranean formation can be modified or an additional component or an additional treatment fluid can be added separately to the subterranean formation in order to address the undesired condition present in the treatment fluid. In some embodiments, a treatment fluid can be monitored downhole using integrated computational element(s) in order to evaluate fluid displacement and fluid diversion in the subterranean formation (e.g, the flow pathway). In such embodiments, real-time or near-real time data from the integrated computational element(s) can be used to adjust the placement of the fluid using diverting agents and to evaluate the effectiveness of diverting agents. Further, in some embodiments, after monitoring a disposition of the treatment fluid using the integrated computational element(s), the treatment fluid may be altered, if desired, to change the way in which the subterranean formation is being treated. In some embodiments, the diverting agents can be added to the treatment fluid in response to a result obtained from the integrated computational element(s).

When utilized for analyzing a fluid within a subterranean formation, the integrated computational element(s) may be present in a fixed location or they may be movable. In some embodiments, the integrated computational element(s) may be affixed at one or more locations within the subterranean formation (e.g., on tubulars). In other embodiments, the integrated computational element(s) may be removably placed at one or more locations within the subterranean formation, such as through wireline deployment, for example. In some embodiments, at least one integrated computational element may be placed substantially adjacent to each subterranean zone. Monitoring an output of the integrated computational element(s) at each subterranean zone may allow a zonal placement of a fluid to be determined.

FIG. 1 shows a schematic of a subterranean formation presenting an illustrative placement of integrated computational elements therein. As illustrated in FIG. 1, subterranean formation 1, which is penetrated by wellbore 10, contains subterranean zones 14, 16, and 18 therein. As depicted in FIG. 1, integrated computational elements 20 may be sited substantially adjacent to each subterranean zone. Optionally or alternatively, in some embodiments, integrated computational element 22 may be sited at the bottom of wellbore 10. For example, in some embodiments, integrated computational element 22 may be used to verify that a treatment fluid has traversed the entire length of wellbore 10. As depicted in FIG. 1, integrated computational elements 20 and 22 are sited in subterranean formation 1 in a wireline-type deployment. However, as discussed above, it is to be understood that the configuration depicted in FIG. 1 is simply for purposes of illustration and not limitation. Furthermore, the number of integrated computational elements depicted in FIG. 1 and their deployment configuration is meant to be illustrative and non-limiting.

As discussed above, the operational simplicity of integrated computational elements may allow them to rapidly produce an output. Accordingly, monitoring fluid disposition within a subterranean formation using one or more integrated computational elements may also take place at a comparable rate (e.g., in real-time or near real-time). This feature represents a key advantage of the present methods over other techniques for monitoring fluid disposition within a subterranean formation, which frequently require much longer periods of time for data analysis. Accordingly, the present methods for monitoring fluid disposition may allow more active process control to be realized with less downtime. For example, if it is identified that a diversion operation has not resulted in satisfactory fluid diversion within a subterranean formation, the diversion operation can be repeated or modified to result in a more satisfactory outcome. Although integrated computational elements may be used to monitor fluid disposition in real-time or near real-time, it is to be recognized that the analytical data collected therewith may be stored and processed in an offline manner, if desired, in some embodiments.

As also discussed above, a significant benefit associated with integrated computational elements is their ability to specifically analyze for a constituent or characteristic of interest. By deploying two or more integrated computational elements together at a location, each integrated computational element being configured for the analysis of a different constituent or characteristic of interest, one can simultaneously monitor two or more different fluid attributes. In the case of fluid diversion operations, for example, a first integrated computational element may be used to verify satisfactory placement of a diverting fluid, and a second integrated computational element may be used to verify that a subsequently introduced fluid is not entering a region of the subterranean formation treated by the diverting fluid. That is, if the diverting operation has occurred as intended, the subsequently introduced fluid should not substantially enter an area treated by the diverting fluid and not be detected by the second integrated computational element. In some embodiments, a third integrated computational element in another location may be used to verify that the subsequently introduced fluid has been directed to a desired region of the subterranean formation.

Another advantage of using integrated computational elements to monitor fluid disposition within a subterranean formation is that they may be used to analyze what happens within the subterranean formation once the fluid reaches its intended location. For example, it may be desirable to verify that the fluid maintains a desired constituent concentration or characteristic of interest once delivered to a given location, or whether a reaction product is being created or not in the presence of the fluid. Thus, in some embodiments, integrated computational elements may be used dually for analyzing fluid disposition and assessing what happens within the subterranean formation in the presence of the fluid. In some embodiments, the same integrated computational element(s) may be used for such dual analysis of the fluid. In other embodiments, different integrated computational elements may be used for this purpose. For example, in some embodiments, a first integrated computational element may be used to assess fluid disposition and a second integrated computational element may be used to determine what happens in the presence of the fluid. In some embodiments, the fluid may be altered in response to the condition measured by the second integrated computational element.

In some embodiments, it may be desirable to utilize a plurality of integrated computational elements to monitor a fluid as it progresses through a subterranean formation. The same or different integrated computational elements may be used to obtain a spatial profile of the fluid's constituent concentration(s) or characteristic(s) of interest within the subterranean formation. For example, it may be desirable to determine how a fluid is changing as it progresses to its end location within the subterranean formation. Changes observed in the fluid as it progresses to its end location may be used to determine whether a treatment fluid needs to be introduced to the subterranean formation or if the fluid needs to be otherwise altered in some manner, for example.

As used herein, the term "fluid" refers to any substance that is capable of flowing, including particulate solids, liquids, gases, slurries, emulsions, powders, muds, glasses, any combination thereof, and the like. In some embodiments, the fluid can be an aqueous fluid, including water, mixtures of water and water-miscible fluids, and the like. In some embodiments, the fluid can be a non-aqueous fluid, including organic compounds (i.e., hydrocarbons, oil, a refined component of oil, petrochemical products, and the like). In some embodiments, the fluid can be a treatment fluid or a formation fluid.

As used herein, the term "treatment fluid" refers to a fluid that is placed in a subterranean formation or in a pipeline in order to perform a desired function. Treatment fluids can be used in a variety of subterranean operations, including, but not limited to, drilling operations, production treatments, stimulation treatments, remedial treatments, fluid diversion operations, fracturing operations, secondary or tertiary enhanced oil recovery (EOR) operations, and the like. As used herein, the terms "treat," "treatment," "treating," and other grammatical equivalents thereof refer to any operation that uses a fluid in conjunction with performing a desired function and/or achieving a desired purpose. The terms "treat," "treatment," and "treating," as used herein, do not imply any particular action by the fluid or any particular component thereof unless otherwise specified. Treatment fluids for subterranean operations can include, for example, drilling fluids, fracturing fluids, acidizing fluids, conformance treatment fluids, damage control fluids, remediation fluids, scale removal and inhibition fluids, chemical floods, and the like.

As used herein, the terms "real-time" and "near real-time" refer to an output by an integrated computational element that is produced on substantially the same time scale as the optical interrogation of a substance with electromagnetic radiation. That is, a "real-time" or "near real-time" output does not take place offline after data acquisition and post-processing techniques. An output that is returned in "real-time" may be returned essentially instantaneously. A "near real-time" output may be returned after a brief delay, which may be associated with processing or data transmission time, or the like. It will be appreciated by one having ordinary skill in the art that the rate at which an output is received may be dependent upon the processing and data transmission rate. In some embodiments described herein, the disposition of a fluid within a subterranean formation may be determined in real-time or near real-time using one or more integrated computational elements in optical communication with the subterranean formation.

As used herein, the term "disposition" refers to a substance's spatial location without reference to a point of time.

As used herein, the term "position" and grammatical equivalents thereof refer to a substance's spatial location at a fixed point in time.

As used herein, the term "progression" and grammatical equivalents thereof refer to a substance's movement between a series of locations over a period of time.

As used herein, the term "placement" and grammatical equivalents thereof refer to a substance's end position following its progression.

As used herein, the term "electromagnetic radiation" refers to radio waves, microwave radiation, infrared and near-infrared radiation, visible light, ultraviolet radiation, X-ray radiation, and gamma ray radiation.

Figure 2:
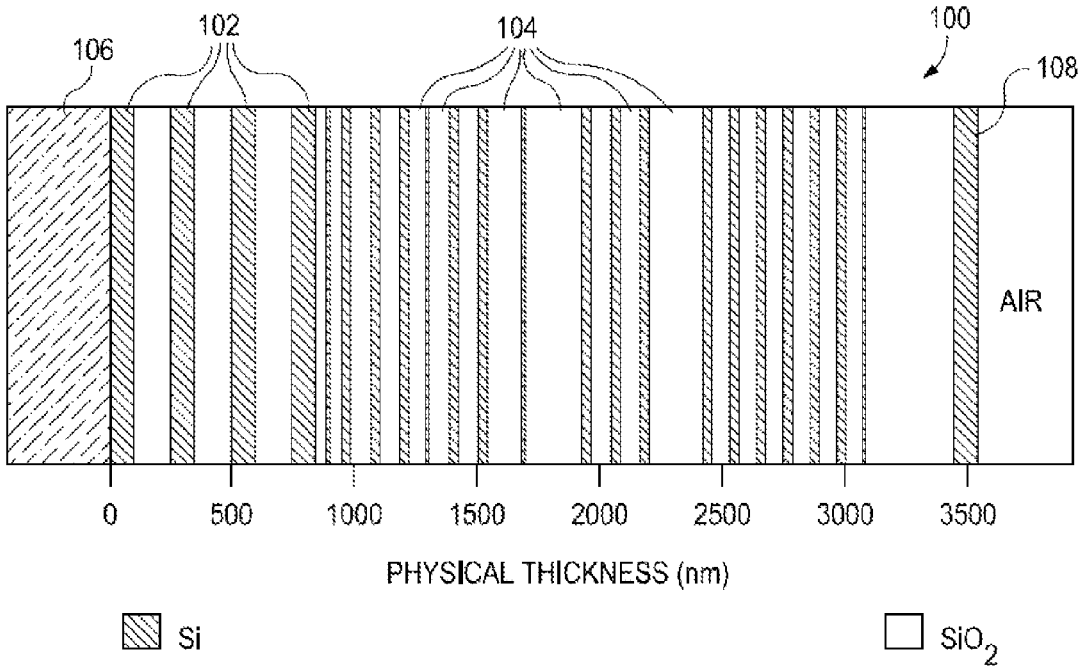
FIG. 2 shows a schematic of an illustrative integrated computational element.

FIG. 2 shows a schematic of an illustrative integrated computational element (ICE) 100. As illustrated in FIG. 2, ICE 100 may include a plurality of alternating layers 102 and 104 of varying thicknesses disposed on optical substrate 106. In general, the materials forming layers 102 and 104 have indices of refraction that differ (i.e., one has a low index of refraction and the other has a high index of refraction), such as Si and $SiO_2$. Other suitable materials for layers 102 and 104 may include, but are not limited to, niobia and niobium, germanium and germania, MgF, and SiO. Additional pairs of materials having high and low indices of refraction can be envisioned by one having ordinary skill in the art, and the composition of layers 102 and 104 is not considered to be particularly limited. In some embodiments, the material within layers 102 and 104 can be doped, or two or more materials can be combined in a manner to achieve a desired optical response. In addition to solids, ICE 100 may also contain liquids (e.g., water) and/or gases, optionally in combination with solids, in order to produce a desired optical response. The material forming optical substrate 106 is not considered to be particularly limited and may comprise, for example, BK-7 optical glass, quartz, sapphire, silicon, germanium, zinc selenide, zinc sulfide, various polymers (e.g., polycarbonates, polymethylmethacrylate, polyvinylchloride, and the like), diamond, ceramics, and the like. Opposite to optical substrate 106, ICE 100 may include layer 108 that is generally exposed to the environment of the device or installation in which it is used.

The number, thickness, and spacing of layers 102 and 104 may be determined using a variety of approximation methods based upon a conventional spectroscopic measurement of a sample. These methods may include, for example, inverse Fourier transform (IFT) of the optical transmission spectrum and structuring ICE 100 as a physical representation of the IFT. The approximation methods convert the IFT into a structure based on known materials with constant refractive indices.

It should be understood that illustrative ICE 100 of FIG. 2 has been presented for purposes of illustration only. Thus, it is not implied that ICE 100 is predictive for any particular constituent or characteristic of a given fluid. Furthermore, it is to be understood that layers 102 and 104 are not necessarily drawn to scale and should therefore not be considered as limiting of the present disclosure. Moreover, one having ordinary skill in the art will readily recognize that the materials comprising layers 102 and 104 may vary depending on factors such as, for example, the types of substances being analyzed and the ability to accurately conduct their analysis, cost of goods, and/or chemical compatibility issues.

It is to be recognized the embodiments herein may be practiced with various blocks, modules, elements, components, methods and algorithms, which can be implemented through using computer hardware, software and combinations thereof. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the spirit and scope of the embodiments expressly described.

Computer hardware used to implement the various illustrative blocks, modules, elements, components, methods and algorithms described herein can include a processor configured to execute one or more sequences of instructions, programming or code stored on a readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable PROM), registers, hard disks, removable disks, CD-ROMS, DVDs, or any other like suitable storage device.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

In some embodiments, methods described herein may comprise: introducing a first fluid into a subterranean formation; and monitoring a disposition of the first fluid within the subterranean formation using one or more integrated computational elements in optical communication with the subterranean formation.

In some embodiments, the methods may further comprise altering the first fluid after monitoring its disposition within the subterranean formation. For example, in some embodiments, once a disposition of the first fluid in the subterranean formation is known, a characteristic of the fluid may be altered to change its disposition in the subterranean formation. Altering a characteristic of the fluid may comprise, for example, changing the fluid's viscosity, pH, specific gravity, or the like. In some embodiments, the fluid's chemical composition may be altered by adding another constituent to the fluid.

In some embodiments, monitoring a disposition of a fluid using one or more integrated computational elements may take place in real-time or near real-time. In other various embodiments, data acquired using the integrated computational element(s) may be stored and processed offline at a later time. Furthermore, in still other embodiments, remote monitoring of the integrated computational element(s) may take place.

In some embodiments, one or more of the integrated computational elements may be present in the subterranean formation. In some or other embodiments, one or more of the integrated computational elements may be optically connected to the subterranean formation via an optical fiber or like conduit for electromagnetic radiation extending into the subterranean formation. In some embodiments, the subterranean formation may be penetrated by a wellbore, where the one or more integrated computational elements are located within the wellbore.

In some embodiments, fluid disposition within a subterranean formation may be monitored using one integrated computational element that is in optical communication with the subterranean formation. For example, in some embodiments, the integrated computational element may be used to assess if a fluid has reached or passed a location in the subterranean formation at which the integrated computational element is sited or with which the integrated computational element is in optical communication. In other embodiments, there may be a plurality of integrated computational elements in optical communication with the subterranean formation. In some embodiments, there may be a plurality of integrated computational elements sited at multiple locations within a wellbore or in optical communication with multiple locations within a wellbore. Monitoring fluid disposition using a plurality of integrated computational elements may take place similarly to that described for one integrated computational element. However, when a plurality of integrated computational elements is present, dynamics of the fluid flow within a subterranean formation may be more readily determined.

When a plurality of integrated computational elements are used for monitoring fluid disposition, any number of integrated computational elements may be present. In some embodiments, there may be 2 integrated computational elements, or 3 integrated computational elements, or 4 integrated computational elements, or 5 integrated computational elements, or 6 integrated computational elements, or 7 integrated computational elements, or 8 integrated computational elements, or 9 integrated computational elements, or 10 integrated computational elements. In some embodiments, there may be about 10 or more integrated computational elements, or about 20 or more integrated computational elements, or about 50 or more integrated computational elements, or about 100 or more integrated computational elements, or about 200 or more integrated computational elements, or about 300 or more integrated computational elements, or about 400 or more integrated computational elements, or about 500 or more integrated computational elements, or about 1000 or more integrated computational elements. Given the benefit of the present disclosure and the particular fluid disposition information desired to be obtained, one of ordinary skill in the art will be able to choose a sufficient number of integrated computational elements and their siting in a subterranean formation to accomplish a given task.

In some embodiments, an integrated computational element may be sited at or in optical communication with about every 10 feet within the subterranean formation. In other embodiments, an integrated computational element may be sited at or in optical communication with about every 20 feet within the subterranean formation, or about every 30 feet, or about every 40 feet, or about every 50 feet, or about every 100 feet, or about every 200 feet, or about every 300 feet, or about every 400 feet, or about every 500 feet. Spacing of the integrated computational elements within the subterranean formation may be regular or irregular depending on the particular attributes of the formation that will be evident to one having ordinary skill in the art. Further, in some embodiments, more than one integrated computational element may be present at some sites, while other sites have only one integrated computational element. In other embodiments, each site may have more than one integrated computational element. In still other embodiments, each site may have one integrated computational element.

In some embodiments, the subterranean formation may comprise one or more subterranean zones, and at least one integrated computational element may be sited substantially adjacent to each subterranean zone or in optical communication with a location substantially adjacent to each subterranean zone. As used herein, the term "subterranean zone" refers to a region of a subterranean formation that has a permeability or composition differing from an adjacent region of the subterranean formation. Use of a plurality of integrated computational elements in this manner may allow one to determine whether a fluid has been delivered to a desired or undesired subterranean zone.

In some embodiments, monitoring a disposition of a fluid within a subterranean formation may comprise monitoring for a constituent within the fluid or monitoring a characteristic of a fluid. Monitoring a constituent within the fluid may comprise monitoring its concentration, for example. In various embodiments, monitoring a disposition of a fluid within a subterranean formation may comprise determining a placement of the fluid within the subterranean formation. For example, in some embodiments, monitoring a disposition of the fluid in a subterranean formation may comprise monitoring a placement of the fluid within a subterranean zone. In other various embodiments, monitoring a disposition of a fluid within a subterranean formation may comprise determining a progression of the fluid within the subterranean formation. For example, in some embodiments, a plurality of integrated computational elements may be used to determine the progression of a fluid within a wellbore penetrating a subterranean formation.

As discussed above, constituents present within a fluid or characteristics of a fluid may be monitored using one or more integrated computational elements according to the embodiments described herein. In general, any constituent present within a fluid can be monitored using an integrated computational element configured to analyze for the constituent. Characteristics of a fluid may be monitored using an integrated computational element in a like manner. Characteristics of a fluid that can be monitored using an integrated computational element may include both chemical properties and physical properties, which may also include optical properties and mechanical properties. Illustrative characteristics of a fluid that may be monitored using an integrated computational element may include, without limitation, viscosity, ionic strength, pH, total dissolved solids, total dissolved salt, density, total particulate solids, opacity, bacteria content, and the like.

In some embodiments, monitoring a disposition of a fluid within the subterranean formation may comprise detecting a constituent or a characteristic of the fluid, a reaction product formed from a constituent of the fluid, a substance formed in the presence of the fluid, a substance formed in the absence of the fluid, a decline in a substance formed in the absence of a fluid, or any combination thereof. Monitoring any of these parameters may allow one to determine where the fluid has travelled or is present within the subterranean formation.

In some embodiments, it may be desirable to both monitor the disposition of a fluid in the subterranean formation and to analyze for a constituent or characteristic of the fluid. For example, after a fluid has reached its end location in the subterranean formation, it may then be desirable to know if the fluid composition and characteristics are still within acceptable parameters. In some embodiments, after or while monitoring a disposition of the fluid within the subterranean formation, the methods may further comprise analyzing for a constituent or a characteristic of the fluid using one or more integrated computational elements. In some embodiments, the constituent or characteristic being analyzed may be the same as those used to determine the disposition of the fluid. In other embodiments, the constituent or characteristic being analyzed may be different. In embodiments in which different constituents or characteristics are being analyzed, more than one integrated computational element may be sited at or in optical communication with the same location, where the integrated computational elements are differentially configured to analyze for different constituents or characteristics. That is, in such embodiments, a first integrated computational element may be used for monitoring fluid disposition and a second integrated computational element may be used to monitor a constituent or characteristic of the fluid during or after its placement in the subterranean formation.

In some embodiments, the fluid being monitored by the one or more integrated computational elements may comprise a treatment fluid. Treatment fluids that may be monitored according to the embodiments described herein include, for example, drilling fluids, fracturing fluids, gravel packing fluids, acidizing fluids, conformance control fluids, gelled fluids, fluids comprising a relative permeability modifier, diverting fluids, fluids comprising a breaker, biocidal treatment fluids, remediation fluids, scale inhibitor fluids, corrosion inhibitor fluids, friction reducing fluids, any combination thereof, and the like. In some embodiments, an injection fluid, such as used in enhanced oil recovery operations may be monitored.

In some embodiments, the treatment fluids described herein may comprise an aqueous carrier fluid. Suitable aqueous carrier fluids may include, but are not limited to, fresh water, acidified water, salt water, seawater, brine, aqueous salt solutions, surface water (i.e., streams, rivers, ponds and lakes), underground water from an aquifer, municipal water, municipal waste water, or produced water from a subterranean formation. In some or other embodiments, the treatment fluids may comprise an oleaginous carrier fluid. Suitable oleaginous carrier fluids may include, for example, oil, hydrocarbons, water-in-oil emulsions, and the like.

In some embodiments, after or while introducing a first fluid into the subterranean formation and monitoring its disposition, a second fluid may be introduced into the subterranean formation. For example, in some embodiments, after or while introducing a first fluid and determining if the first fluid has entered a desired region of the subterranean formation, a second fluid may be introduced to the subterranean formation. In some embodiments, the first fluid and the second fluid may be the same, and in other embodiments, the first fluid and the second fluid may be different. For example, in some embodiments, the first fluid may comprise a diverting fluid and the second fluid may comprise a different treatment fluid, such as an acidizing fluid. Once a desired placement of the diverting fluid has been confirmed using the integrated computational element(s), the likelihood of directing the second fluid to a desired region of the subterranean formation may be increased. In some embodiments, the methods may further comprise monitoring a disposition of the second fluid in the subterranean formation using one or more integrated computational elements.

In the alternative, before introducing the first fluid to the subterranean formation, the methods may further comprise performing a diverting operation in the subterranean formation. For example, in some embodiments, a diverting fluid may be introduced to the subterranean formation prior to introducing the first fluid so as to direct the first fluid to a desired location within the subterranean formation. In some embodiments, the disposition of the diverting fluid in the subterranean formation may also be monitored using one or more integrated computational elements.

In some embodiments, methods described herein may comprise: providing a diverting fluid comprising a diverting agent; introducing the diverting fluid into a subterranean formation comprising one or more subterranean zones; after or while introducing the diverting fluid, introducing a treatment fluid to the subterranean formation; and monitoring a disposition of the treatment fluid within the subterranean formation using one or more integrated computational elements in optical communication with the subterranean formation.

In some embodiments, monitoring a disposition of the treatment fluid in the subterranean formation may comprise determining a placement of the treatment fluid in the subterranean formation. In some embodiments, monitoring a disposition of the treatment fluid within the subterranean formation may take place in real-time or near real-time.

In some embodiments, methods described herein may comprise: providing a diverting fluid comprising a diverting agent; introducing the diverting fluid into a subterranean formation comprising one or more subterranean zones; and monitoring a disposition of the diverting fluid within the subterranean formation using one or more integrated computational elements in optical communication with the subterranean formation.

In some embodiments, monitoring a disposition of the diverting fluid in the subterranean formation may comprise monitoring a placement of the diverting fluid in the subterranean formation, for example, in or near one or more subterranean zones. In some embodiments, monitoring a disposition of the diverting fluid may comprise detecting the diverting agent or a reaction product formed therefrom, a characteristic of the diverting fluid, or any combination thereof.

In some embodiments, monitoring a disposition of the diverting fluid using one or more integrated computational elements may take place in real-time or near real-time. In other various embodiments, data acquired using the integrated computational element(s) may be stored and processed offline at a later time.

In some embodiments, the diverting fluid may comprise a non-reactive diverting agent. A non-reactive diverting agent may form an at least partially impermeable fluid barrier in a subterranean formation without undergoing a chemical reaction. Examples of non-reactive diverting agents may include, for example, relative permeability modifiers and particulates that agglomerate to form a fluid barrier within the subterranean formation. In other embodiments, the diverting fluid may comprise a reactive diverting agent. A reactive diverting agent may form an at least partially impermeable fluid barrier in a subterranean formation by forming a reaction product. Examples of reactive diverting agents may include, for example, adhesives, gellable polymers, and the like that form a fluid barrier after undergoing a chemical reaction.

In some embodiments, after or while introducing the diverting fluid into a subterranean formation and monitoring its disposition therein, a second fluid may be introduced to the subterranean formation. In some embodiments, the second fluid may comprise a treatment fluid, which may comprise any of those described above. If the diverting fluid has functioned as intended, the treatment fluid will be directed away from regions of the subterranean formation in which the diverting fluid has formed a fluid seal or like barrier. In some embodiments, methods described herein may comprise introducing a treatment fluid to a subterranean formation after or while introducing a diverting fluid, and interacting the treatment fluid with a subterranean zone. In some embodiments, the methods may further comprise monitoring disposition of the treatment fluid after its introduction to the subterranean formation, using one or more integrated computational elements. For example, in some embodiments, the methods may further comprise monitoring a placement of the treatment fluid in the subterranean formation using one or more integrated computational elements that are in optical communication with the subterranean formation.

In more particular embodiments, the treatment fluid being introduced to the subterranean formation after introduction of the diverting fluid may comprise an acidizing fluid. As described above, proper placement of an acidizing fluid in a subterranean formation may be desirable, for example, to avoid over stimulation of high permeability subterranean zones in preference to lower permeability subterranean zones.

In some embodiments, methods described herein may comprise: providing an acidizing fluid comprising at least one acid or acid-generating compound; introducing the acidizing fluid into a subterranean formation comprising one or more subterranean zones; and monitoring a disposition of the acidizing fluid within the subterranean formation using one or more integrated computational elements in optical communication with the subterranean formation.

Acid-generating compounds include substances that degrade (e.g., within a subterranean formation) to produce at least one acid. Suitable acid-generating compounds may include, for example, esters, orthoesters and degradable polymers such as polylactic acid and polyglycolic acid.

In addition to at least one acid or acid-generating compound, acidizing fluids suitable for use in the present embodiments may optionally contain other components in addition to the at least one acid. Two of the more notable components are chelating agents and/or corrosion inhibitors, for example. Chelating agents can slow or prevent the precipitation of formation solids that are liberated upon reaction with an acid. Corrosion inhibitors can slow or prevent the degradation of metal tools used during the performance of an acidizing operation. Other components that can optionally be present in the acidizing fluids of the present embodiments include for example, a surfactant, a gelling agent, a salt, a scale inhibitor, a polymer, an anti-sludging agent, a diverting agent, a foaming agent, a buffer, a clay control agent, a consolidating agent, a breaker, a fluid loss control additive, a relative permeability modifier, a tracer, a probe, nanoparticles, a weighting agent, a rheology control agent, a viscosity modifier, and any combination thereof. Any of these additional components can also be monitored using an integrated computational element according to the methods described herein.

In some embodiments, a diverting fluid may be introduced into the subterranean formation in conjunction with performing an acidizing operation with an acidizing fluid. In some embodiments, the diverting fluid may be introduced to the subterranean formation before introducing the acidizing fluid. In some or other embodiments, the diverting fluid may be introduced to the subterranean formation concurrently with introducing the acidizing fluid. In still other embodiments, the acidizing fluid itself may comprise a diverting agent, and the acidizing fluid may be self-diverting.

In some embodiments, acidizing fluids being monitored using one or more integrated computational elements may comprise at least one acid. In various embodiments, the at least one acid may comprise a mineral acid such as hydrofluoric acid or hydrochloric acid, for example. In some or other embodiments, the at least one acid may comprise an organic acid such as formic acid, acetic acid, glycolic acid, or lactic acid for example. As one of ordinary skill in the art will recognize, the type of subterranean formation being treated with the acidizing fluid may dictate the choice of acid used. When treating a carbonate formation, for example, it may be more desirable to use hydrochloric acid, formic acid, or acetic acid. These acids may be ineffective for acidizing a siliceous formation such as, for example, a sandstone formation. When acidizing a sandstone formation, treatment with hydrofluoric acid may be more desirable.

In some embodiments, the subterranean formation being treated with an acidizing fluid and monitored by the methods described herein may comprise a carbonate formation. In some embodiments, the subterranean formation being treated with an acidizing fluid and monitored by the methods described herein may be penetrated by a wellbore comprising a substantially horizontal section. When acidizing a wellbore having a substantially horizontal section, the present methods may be particularly advantageous, since over-stimulation of the heel of the wellbore is a commonly encountered problem in the art. By applying the present methods, one can determine if an acidizing fluid has been disposed in a desired location and if a desired effect has been achieved.

In some embodiments, the subterranean formation being treated with the acidizing fluid and monitored by the methods described herein may comprise a siliceous formation, such as a sandstone formation, for example. As discussed above, siliceous formations may be effectively acidized with acidizing fluids containing hydrofluoric acid or a hydrofluoric acid-generating compound. Acidizing operations in siliceous formations may be monitored, for example, by detecting the presence of hydrofluoric acid in the subterranean formation or a reaction product formed from the hydrofluoric acid and a component of the subterranean formation. Specifically, the reaction product being monitored may comprise dissolved silicates and/or aluminosilicates leeched from the matrix of the subterranean formation. In addition to monitoring the progression of hydrofluoric acid, a hydrofluoric acid-generating compound, or a reaction product formed therefrom in a subterranean formation, the production of various insoluble materials from the reaction product may also be monitored using the integrated computational elements. As one of ordinary skill in the art will recognize, silicates, fluorosilicates, and fluoroaluminates may react under certain conditions (e.g., in the presence of alkali metals) to form highly insoluble precipitates that may damage the subterranean formation being treated. The precipitates may be very difficult to remediate. Accordingly, the ability to detect the production of these substances when acidizing a siliceous formation may represent an added benefit of monitoring fluid progression using one or more integrated computational elements. A more detailed discussion of the problems associated with acidizing siliceous formations may be found in commonly owned U.S. patent application Ser. No. 12/917,167, filed on Nov. 1, 2010, and Ser. No. 13/051,827, filed on Mar. 18, 2011, each of which is incorporated herein by reference in its entirety.

In some, monitoring a disposition of the acidizing fluid in the subterranean formation may comprise monitoring a progression of the acidizing fluid in the subterranean formation. In some embodiments, a flow rate of the acidizing fluid within the subterranean formation may be determined by monitoring its progression therein. In some or other embodiments, monitoring a disposition of the acidizing fluid in the subterranean formation may comprise monitoring a placement of the acidizing fluid in the subterranean formation. In some embodiments, the methods may further comprise determining an amount of penetration of the acidizing fluid into a subterranean zone using one or more integrated computational elements. Determining an amount of penetration of the acidizing fluid into a subterranean zone may comprise, for example, monitoring a constituent concentration and/or characteristic of the acidizing fluid as it changes over time. For example, a decrease in a constituent concentration may be indicative of its penetration into a subterranean zone. In a similar manner to that described above, monitoring a disposition of the acidizing fluid within a subterranean formation using one or more integrated computational elements may comprise, for example, measuring pH, detecting the at least one acid or a reaction product formed therefrom, or any combination thereof. Changes in the composition or characteristics of the acidizing fluid may be indicative of its reaction with the surface of the subterranean formation, thereby resulting in dissolution of the formation matrix. For example, when acidizing a carbonate formation, dissolution of the formation matrix may result in the desirable creation of wormholes within the formation face that result in an increase in its permeability. Detection of carbon dioxide or dissolved ions from the formation matrix (e.g., $Ca^{2+}$) may be used to monitor disposition of the acidizing fluid in various embodiments.

Although the presence of a reaction product formed between the acidizing fluid and the formation matrix may be indicative of the acidizing fluid's penetration into the subterranean formation, in some cases, the subterranean formation's permeability may still not be increased to a desired degree. Specifically, in some embodiments, bulk erosion of the surface of the subterranean formation may occur rather than the desired wormhole formation. Simply monitoring the subterranean formation for the creation of a reaction product or consumption of the acidizing fluid may be insufficient in some cases to determine whether wormhole formation or bulk erosion has occurred, since the acidizing fluid is consumed and the same reaction product formed in either case. To distinguish between wormhole formation and bulk erosion, in some embodiments, it may be desirable to monitor for other components of the formation matrix that may be liberated during acidizing. For example, during wormhole formation, it is expected that primarily the acid-soluble components of the formation matrix will be released. In contrast, during bulk erosion, secondary components of the subterranean formation that are not necessarily acid soluble may be released from the formation matrix into the acidizing fluid. Detection of an excessive amount of these secondary components using one or more integrated computational elements may indicate that the acidizing operation needs to be altered in some manner. For example, in some embodiments, if secondary component analysis indicates bulk erosion rather than wormhole formation, the flow rate of the acidizing fluid may be altered or its concentration may be changed.

In still other embodiments, monitoring a disposition of the acidizing fluid within the subterranean formation may further comprise monitoring a surface within the subterranean formation. For example, in some embodiments, bulk erosion of the surface of the subterranean formation may be detected using an integrated computational element that is positioned to monitor the formation face itself and is configured to detect a constituent therein. Specifically, a change in output of an integrated computational element monitoring the formation face may be indicative of bulk erosion. For example, a distance between the formation face and the integrated computational element may be increased by bulk erosion, such that less electromagnetic radiation that has optically interacted with the formation face is received by the integrated computational element. With wormhole formation, in contrast, it is believed that the distance between the formation face and the integrated computational element will not change appreciably, such that the amount of received electromagnetic radiation remains roughly the same. In some embodiments, the surface being monitored within the formation may comprise the well string, for example. For example, in an acidizing operation, pitting of the well string by the acidizing fluid may be monitored using an integrated computational element monitoring the well string's surface.

In some embodiments, the techniques described herein may also be applicable in injection operations, such as those used in enhanced oil recovery. In injection operations, a fluid may be injected into a first wellbore for the purposes of pressurizing the subterranean formation, so as to stimulate one or more neighboring wellbores. The injection fluid may flow from the injection wellbore to the neighboring wellbores, and fluid pressure exerted by the injection fluid may drive a formation fluid toward the neighboring wellbores, thereby allowing the formation fluid to be produced. The injection fluid may also chemically change a flow pathway between the injection wellbore and the neighboring wellbores so as to reduce resistance of the formation fluid flowing toward the neighboring wellbores. For example, in some embodiments, a surfactant within the injection fluid may reduce the interfacial tension between the subterranean formation and the formation fluid, thereby allowing the formation fluid to flow more easily to the one or more neighboring wellbores.

When conducting injection operations, dyes or like tracers are often included within the injection fluid in order to provide a marker for monitoring the progression of the injection fluid from a first location to a second location. In the case of injection operations, progression of the dyes or like tracers from the injection wellbore to the neighboring wellbore(s) may be indicative of the passage of the injection fluid therebetween. Passage of the injection fluid from the injection wellbore to the production wellbore may be indicative that the injection operation has functioned as intended and predictive of the success of the injection operation. Current methods of analyzing for the dyes or like tracers may not be possible in real-time or near real-time, particularly while the injection fluid is downhole, which may limit one's ability to proactively control an injection operation.

In some embodiments, tracers and/or probes can be deployed in the fluids used in the present methods. As used herein, the term "tracer" refers to a substance that is used in a fluid to assist in the monitoring of the fluid in a subterranean formation or in a fluid being produced from a subterranean formation. Illustrative tracers can include, for example, fluorescent dyes, radionuclides, and like substances that can be detected in exceedingly small quantities. A tracer typically does not convey information regarding the environment to which it has been exposed, unlike a probe. As used herein, the term "probe" refers to a substance that is used in a fluid to interrogate and deliver information regarding the environment to which it has been exposed. Upon monitoring the probe, physical and chemical information regarding a subterranean formation can be obtained.

In some embodiments, the present methods can comprise monitoring a tracer or a probe in a fluid using an integrated computational element. In some embodiments, the tracer or probe can be monitored in a fluid being produced from a subterranean formation. In other embodiments, the tracer or probe can be monitored within the subterranean formation. In some embodiments, tracers or probes in a fluid can be monitored using an integrated computational element in order to determine a flow pathway for the fluid in the subterranean formation. In some embodiments, monitoring of tracers or probes can be used to determine the influence of diverting agents on the flow pathway.

In some embodiments, methods described herein may comprise: providing an injection wellbore penetrating a subterranean formation, the injection wellbore being in fluid communication with one or more neighboring wellbores; introducing an injection fluid to the injection wellbore; and monitoring a progression of the injection fluid within the injection wellbore or in the one or more neighboring wellbores using one or more integrated computational elements in optical communication with the injection wellbore or the one or more neighboring wellbores. In some embodiments, introducing the injection fluid to the injection wellbore may comprise pressurizing the injection wellbore with the injection fluid. In some embodiments, pressurizing the injection wellbore may stimulate the one or more neighboring wellbores so as to produce a formation fluid, such as oil.

In some embodiments, monitoring a progression of the injection fluid in the injection wellbore or in the one or more neighboring wellbores may take place in real-time or near real-time.

In some embodiments, the injection fluid may comprise a spectroscopically active substance. In some embodiments, the injection fluid may comprise a spectroscopically active substance within a fluid phase, which may comprise an aqueous fluid in some embodiments. In some embodiments, the spectroscopically active substance of the injection fluid may comprise a dye or like tracer that is conventionally used in injection operations. For example, in some embodiments, the spectroscopically active substance may comprise a fluorescent molecule.

In some embodiments, monitoring a progression of the injection fluid within the subterranean formation may comprise detecting a spectroscopically active substance within the injection wellbore or in the one or more neighboring wellbores. Detecting the disappearance of the spectroscopically active substance within the injection wellbore may provide evidence of its progression therefrom. Detecting the appearance of the spectroscopically active substance within the one or more neighboring wellbores may provide direct evidence of its progression thereto.

In some embodiments, the injection fluid may lack a dye or like tracer. In such embodiments, monitoring a progression of the injection fluid may take place by analyzing for a component of the injection fluid or a characteristic thereof using one or more integrated computational elements in optical communication with the injection wellbore or the one or more neighboring wellbores.

It is to be recognized that the fluids described herein may further comprise various additional components other than those expressly described. Illustrative substances that can be present in any of the fluids described herein may include, for example, acids, acid-generating compounds, bases, base-generating compounds, surfactants, scale inhibitors, corrosion inhibitors, gelling agents, crosslinking agents, anti-sludging agents, foaming agents, defoaming agents, antifoam agents, emulsifying agents, de-emulsifying agents, iron control agents, proppants or other particulates, gravel, particulate diverters, salts, fluid loss control additives, gases, catalysts, clay control agents, chelating agents, corrosion inhibitors, dispersants, flocculants, scavengers (e.g., $H_2S$ scavengers, $CO_2$ scavengers or $O_2$ scavengers), lubricants, breakers, delayed release breakers, friction reducers, bridging agents, viscosifiers, weighting agents, solubilizers, rheology control agents, viscosity modifiers, pH control agents (e.g., buffers), hydrate inhibitors, relative permeability modifiers, diverting agents, consolidating agents, fibrous materials, bactericides, tracers, probes, nanoparticles, and the like. Combinations of these substances can be used as well. Any of these additional substances may be detected and analyzed using one or more integrated computational elements in order to monitor the disposition of the fluid within the subterranean formation.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

providing a diverting fluid comprising a diverting agent;

introducing the diverting fluid into a subterranean formation comprising one or more subterranean zones; and monitoring a disposition of the diverting fluid within the subterranean formation using an optical computing device containing one or more integrated computational elements which are in optical communication with the subterranean formation and are located on a rotating disc, the one or more integrated computational elements comprising a plurality of alternating layers of materials having differing indices of refraction disposed on a single side of an optical substrate, and a number, thickness and spacing of the layers approximating an inverse Fourier transform of an optical transmission spectrum of a constituent in the diverting fluid;

wherein the one or more integrated computational elements is configured to optically interact with the diverting fluid and thereby generate optically interacted light so that a portion of the optically interacted light is transmitted through the one or more integrated computational elements;

wherein the optical substrate comprises a material selected from the group consisting of optical glass, quartz, sapphire, silicon, germanium, zinc selenide, zinc sulfide, a polymer, diamond, and a ceramic; and wherein the one or more integrated computational elements are configured to detect the constituent from amongst a mixture of other constituents within the diverting fluid and output a number that is correlatable with a concentration of the constituent in the diverting fluid.

2. The method of claim 1, wherein monitoring a disposition of the diverting fluid within the subterranean formation comprises monitoring a placement of the diverting fluid.

3. The method of claim 1, wherein at least one integrated computational element is sited substantially adjacent to each subterranean zone.

4. The method of claim 1, wherein monitoring a disposition of the diverting fluid within the subterranean formation comprises detecting the diverting agent or a reaction product formed therefrom, a characteristic of the diverting fluid, or any combination thereof.

5. The method of claim 1, wherein monitoring a disposition of the diverting fluid within the subterranean formation using the one or more integrated computational elements takes place in real-time or near real-time.

6. The method of claim 1, further comprising:

introducing a treatment fluid to the subterranean formation after or while introducing the diverting fluid; and interacting the treatment fluid with a subterranean zone.

7. The method of claim 6, further comprising:

monitoring a placement of the treatment fluid within the subterranean formation using the one or more integrated computational elements.

8. The method of claim 6, wherein the treatment fluid comprises an acidizing fluid.

9. A method comprising:

providing an acidizing fluid comprising at least one acid or acid-generating compound;

introducing the acidizing fluid into a subterranean formation comprising one or more subterranean zones; and monitoring a disposition of the acidizing fluid within the subterranean formation using an optical computing device containing one or more integrated computational elements which are in optical communication with the subterranean formation and are located on a rotating disc, the one or more integrated computational elements comprising a plurality of alternating layers of materials having differing indices of refraction disposed on a single side of an optical substrate, and a number, thickness and spacing of the layers approximating an inverse Fourier transform of an optical transmission spectrum of a constituent in the acidizing fluid;

wherein the one or more integrated computational elements is configured to optically interact with the acidizing fluid and thereby generate optically interacted light so that a portion of the optically interacted light is transmitted through the one or more integrated computational elements;

wherein the optical substrate comprises a material selected from the group consisting of optical glass, quartz, sapphire, silicon, germanium, zinc selenide, zinc sulfide, a polymer, diamond, and a ceramic; and wherein the one or more integrated computational elements are configured to detect the constituent from amongst a mixture of other constituents within the acidizing fluid and output a number that is correlatable with a concentration of the constituent in the acidizing fluid.

10. The method of claim 9, further comprising:

determining an amount of penetration of the acidizing fluid into a subterranean zone using the one or more integrated computational elements.

11. The method of claim 9, wherein at least one integrated computational element is sited substantially adjacent to each subterranean zone.

12. The method of claim 11, further comprising:

monitoring a progression of the acidizing fluid within the subterranean formation using the one or more integrated computational elements.

13. The method of claim 9, wherein monitoring a disposition of the acidizing fluid within the subterranean formation comprises monitoring a placement of the acidizing fluid within a subterranean zone.

14. The method of claim 9, wherein monitoring a disposition of the acidizing fluid within the subterranean formation comprises measuring pH, detecting the at least one acid or acid-generating compound or a reaction product formed therefrom, or any combination thereof.

15. The method of claim 14, wherein monitoring a disposition of the acidizing fluid within the subterranean formation further comprises monitoring a surface within the subterranean formation.

16. The method of claim 9, wherein monitoring a disposition of the acidizing fluid within the subterranean formation comprises monitoring a surface within the subterranean formation.

17. The method of claim 9, further comprising:

introducing a diverting fluid to the subterranean formation prior to or concurrently with introducing the acidizing fluid.

18. The method of claim 17, further comprising:

monitoring a disposition of the diverting fluid within the subterranean formation using the one or more integrated computational elements.

19. The method of claim 18, further comprising:

determining an amount of penetration of the acidizing fluid into a subterranean zone using the one or more integrated computational elements.

20. The method of claim 9, wherein the subterranean formation comprises a carbonate formation.

21. The method of claim 9, wherein the subterranean formation is penetrated by a wellbore comprising a substantially horizontal section.

22. The method of claim 9, wherein monitoring a disposition of the acidizing fluid within the subterranean formation takes place in real-time or near real-time.

* * * * *